US005961228A

United States Patent [19]

Ward et al.

[11] Patent Number: 5,961,228

[45] Date of Patent: Oct. 5, 1999

[54] MODULAR PRINTER

[75] Inventors: Donald J. Ward, Sayre, Pa.; Donald A. Campbell, Binghamton, N.Y.

[73] Assignee: Paxar Corporation, White Plains, N.Y.

[21] Appl. No.: 08/917,637

[22] Filed: Aug. 22, 1997

[51] Int. Cl.[6] ..... B41J 2/32

[52] U.S. Cl. ..... 400/120.16; 400/82; 400/188; 347/197

[58] Field of Search ..... 400/82, 188, 120.16, 400/120.17, 692; 347/197, 198

[56] References Cited

U.S. PATENT DOCUMENTS

| | | | |
|---|---|---|---|
| 4,776,714 | 10/1988 | Sugiura et al. | 400/248 |
| 4,953,994 | 9/1990 | Shiozaki et al. | 400/120.16 |
| 5,015,324 | 5/1991 | Goodwin et al. | 156/384 |
| 5,150,130 | 9/1992 | Sato | 346/145 |
| 5,266,966 | 11/1993 | Fushimi et al. | 400/120.16 |
| 5,486,057 | 1/1996 | Skinner et al. | 400/188 |
| 5,486,259 | 1/1966 | Goodwin et al. | 156/384 |
| 5,611,629 | 3/1997 | Paranjpe | 400/82 |
| 5,688,057 | 11/1997 | Wright et al. | 400/82 |
| 5,846,003 | 12/1998 | Mori et al. | 400/120.17 |

FOREIGN PATENT DOCUMENTS

| | | | |
|---|---|---|---|
| 2 631 888 | 12/1989 | France | 400/82 |
| 57-69071 | 4/1982 | Japan | 400/82 |
| 58-160155 | 9/1983 | Japan | 400/82 |
| 61-3765 | 1/1986 | Japan | 400/82 |
| 3-53955 | 3/1991 | Japan | 400/82 |

OTHER PUBLICATIONS

Paxar 642 Operation/Maintenance and Parts List edition 3 Feb. 1995.

Paxar Model 656/636 User Manual Edition Edition 1.6 Apr. 15, 1996.

*Primary Examiner*—Christopher A. Bennett
*Attorney, Agent, or Firm*—Joseph J. Grass

[57] ABSTRACT

There is disclosed thermal printer capable of printing on both sides of a web in a single pass wherein there is a straight-through path for the web for ease of threading of a printable web and for simplicity and economy of manufacture, maintenance and use. Print head assemblies can be quickly and easily located at the printing position and yet they can be moved to open or ineffective positions for threading, for cleaning the print head and for maintenance.

20 Claims, 4 Drawing Sheets

24
46'
129
52
47'
112'
138
93
78
15
123'
25
123'
70
70
29
134
134'
124
132

MODULAR PRINTER

BACKGROUND OF THE INVENTION

1. Field of the Invention

This invention relates to the printing field.

2. Brief Description of the Prior Art

Prior art thermal printers are disclosed in U.S. Pat. Nos. 4,776,714; 5,015,324; and 5,150,130; in User Manual for PAXAR Model 656/636, Manual Edition 1.6, Apr. 15, 1996; and in PAXAR 642, Operation/Maintenance and Parts List, Edition 3, February 1995.

SUMMARY OF THE INVENTION

In prior art printers capable of printing on both sides of a web in a single pass, the web undergoes changes in direction as the web travels through the printer. This requires that functional members such as turning bars, rollers or the like be strategically placed so that the web is caused to make the needed directional changes. In addition to such complexity, in the event such functional members are stationary, there is friction against the advancing web. In any event, it takes more energy to advance the web when the web encounters such frictional members. Also, such functional members can make it more difficult to thread the web through the printer and to service the printer.

According to the present invention, there is provided a substantially straight path for the web as the web passes both over and under a plurality of print heads. There is at least one print head on each side of the web as the web passes through the printer. In the illustrated embodiment, there is one print head below the web and there are two print heads above the web. Each print head can print in a different color so that indicia printed on the upper surface of the web can be printed in two colors and the printing on the underside of the web is in one color.

The invention also relates to an improved arrangement for mounting the print head assembly of a print module for pivotal movement about an axis parallel to the platen roll and for selectively releasably locating the print head assembly either in or out of printing cooperation with the platen roll using a readily manually accessible quick-release mechanism. According to a specific embodiment, there is provided a laterally shiftable locator rod which locates in at least one and preferably two recesses or holes to hold the print head assembly in its operating position, or which can be shifted to release the print head assembly to enable the print head assembly to be pivoted to an open, out-of-the-way or non-operating position. It is preferred that the locator rod be biased in the locating direction to cause the locator rod to cooperate with the recess or recesses, but the locator rod can be shifted against the force of the spring to a position where the locator rod ceases to cooperate with any locating recess, whereupon the print head assembly can be moved to the open or non-operating position. It is preferred that the locator rod be provided with a manually engageable knob or handle to facilitate shifting of the locator rod.

BRIEF DESCRIPTION OF THE DIAGRAMMATIC DRAWINGS

DETAILED DESCRIPTION OF THE PREFERRED EMBODIMENTS

Figure 1:
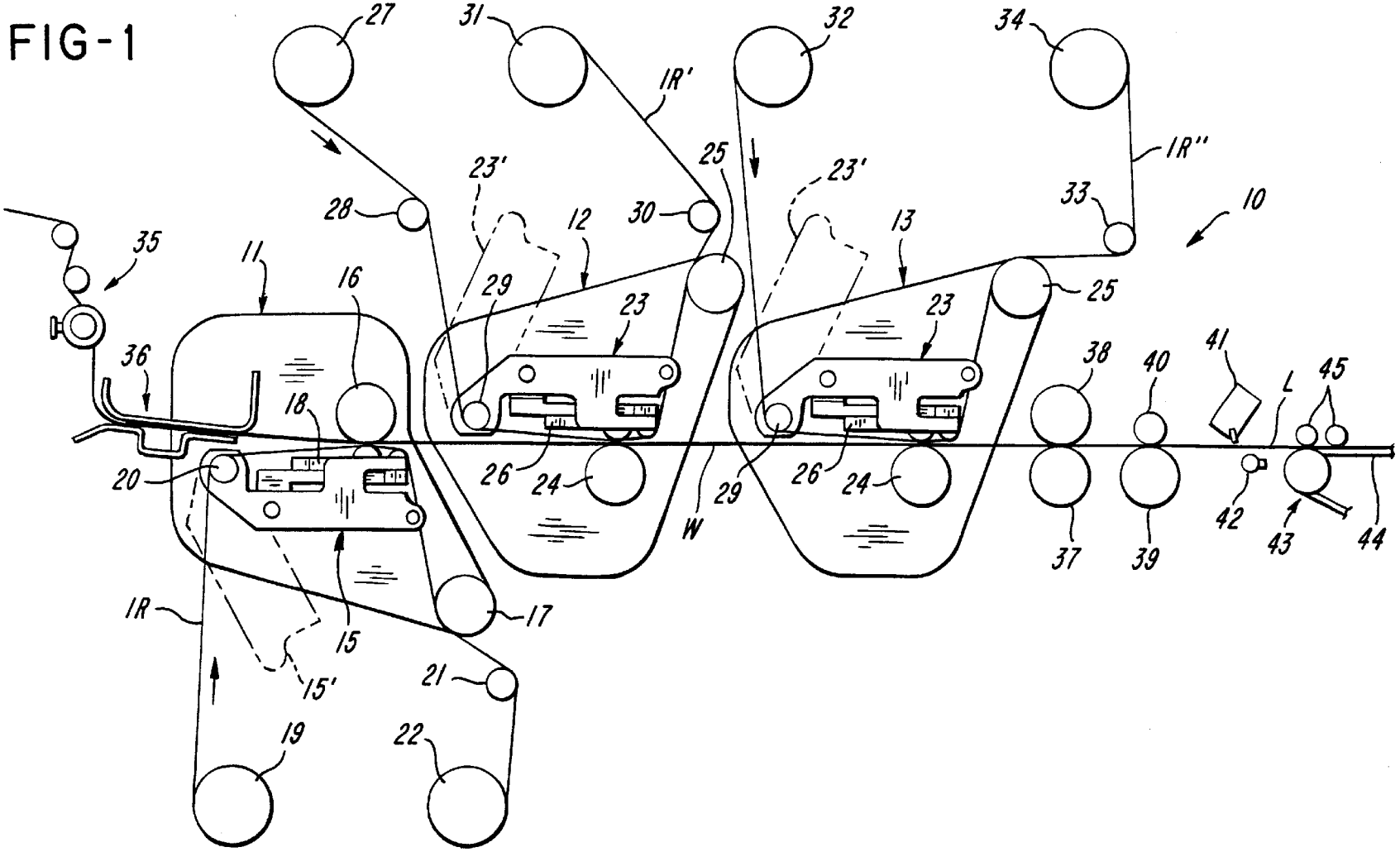
FIG. 1 is a diagrammatic elevational view of the printer showing three print modules.

Referring initially to FIG. 1, there is shown a printer generally indicated at 10 for printing on one or both sides of a web W. The web W can be composed of fabric such as is used to make garment labels and the like or it can be composed of paper, synthetic or other materials. The printer 10 is shown to have cantilevered first, second and third print head modules or print stations 11, 12 and 13. The module 11 includes a first print head assembly 15, a platen roll 16 and an ink ribbon direction changing roll 17. The print head assembly 15 includes a convex-type thermal print head 18. As shown, the web W passes below the platen roll 16 and above the print head 18 so that the underside of the web W is printed with a color determined by the color of the ink ribbon IR. The ink ribbon IR is drawn from a supply roll 19, over a shaft 20, about the print head 18, and in contact with rolls 17 and 21 and onto a take-up roll 22.

The modules 12 and 13 are identical in construction to each other and, therefore, the same reference characters are used for components of both. The modules 12 and 13 have respective second and third print head assemblies 23, platen rolls 24, and ink ribbon direction-changing rolls 25. The platen rolls 16 and 24 extend laterally and are horizontally disposed. The print head assemblies 23 include convex-type thermal print heads 26. As shown, the web W passes below the print heads 26 and above the platen rolls 24 so that the upperside of the web W is printed with colors determined by the colors of respective ink ribbons IR' and IR". The ink ribbon IR' is drawn from a supply roll 27, into contact with a direction-changing roll 28, about a shaft 29 and the print head 26, about rolls 25 and 30 and onto a take-up roll 31. The ink ribbon IR" is drawn from a supply roll 32, about the shaft 29 and the print head 26, about rolls 25 and 33 and onto a take-up roll 34. The axes of the shafts 20 and 29 are parallel to each other and to the platen rolls 16 and 23.

The print head assemblies 15 and 26 are shown in their operating positions, but they can be pivoted about respective axes of shafts 20 and 29 to their open positions as shown by phantom lines 15' and 23' to facilitate threading of the web W, cleaning of the print heads 18 and 26, or to omit printing by one or more print heads 18 and 26. For example, if only one color printing is desired on the upper side of the web, then one of the print head assemblies 23 associated with the color of ink ribbon IR' or IR" which is not desired, can be pivoted into the phantom line position 23'. Also, if printing on only one side of the web W is desired, the print head assembly 15 can be pivoted into the position shown by phantom line 15'. The ink ribbons IR, IR' and IR" can be of any selected colors.

The web W is initially in the form of a roll (not shown) from which the web W moves through a tensioning arrangement 35 and side edge guide structure 36. After the web W has advanced through the modules 11, 12 and 13, the web W passes between the nip of a driven roll 37 and an idler roll 38 and between the nip of a driven roll 39 and an idler roll 40. A stationary cutter 41 cooperating with a rotatable cutter roll 42 cuts the web W into labels or tags L. The labels L pass successively into a stacker generally indicated at 43 which includes a conveyor 44 and rolls 45.

As shown, the web W is on a substantially straight path through the printer 10 between the platen roll 16 and the stacker 43. This facilitates threading of the web W through the printer 10 and obviates the need for turning bars, direction-changing rolls or the like.

Figure 2:
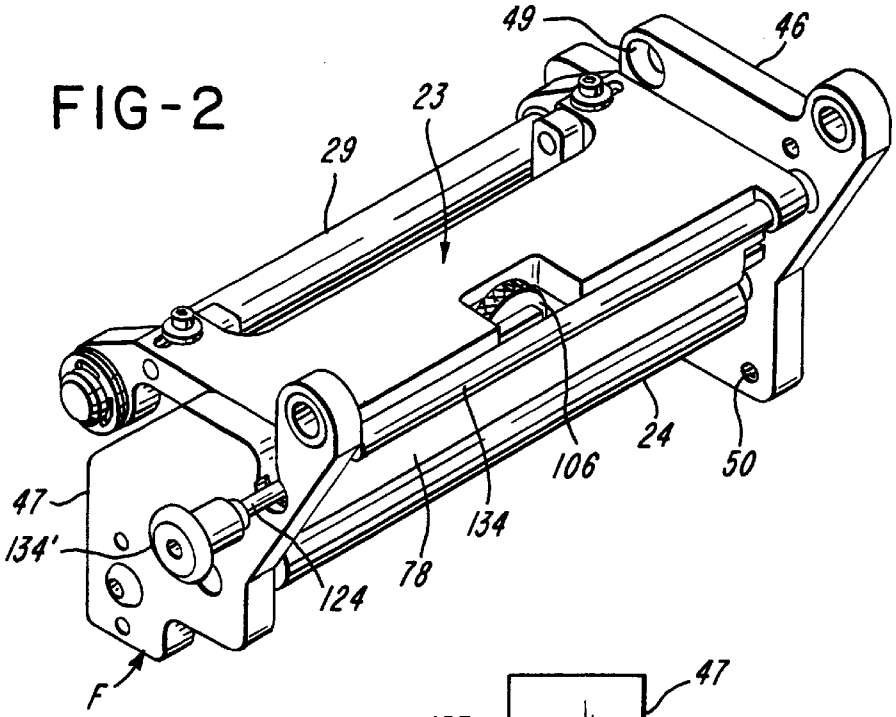
FIG. 2 is a perspective view of one of the print modules.

With reference to FIG. 2, there is illustrated one of the modules 12. The module 12 includes a rear plate 46 and a laterally spaced front plate 47. The rear plate 46 is secured to a vertical printer frame 48 (FIG. 4)by machine screws (not shown) passing through holes 49 and 50. The shaft 29 anchored in hole 51 (FIG. 3) in the plate 46 pivotally mounts the print head assembly 23. The rear and front plates 46 and 47 and the shaft 29 are stationary and the print head assembly 23 is pivotal from its operating position shown by solid lines in FIG. 2 to an open position shown by phantom lines 23'.

Figure 3:
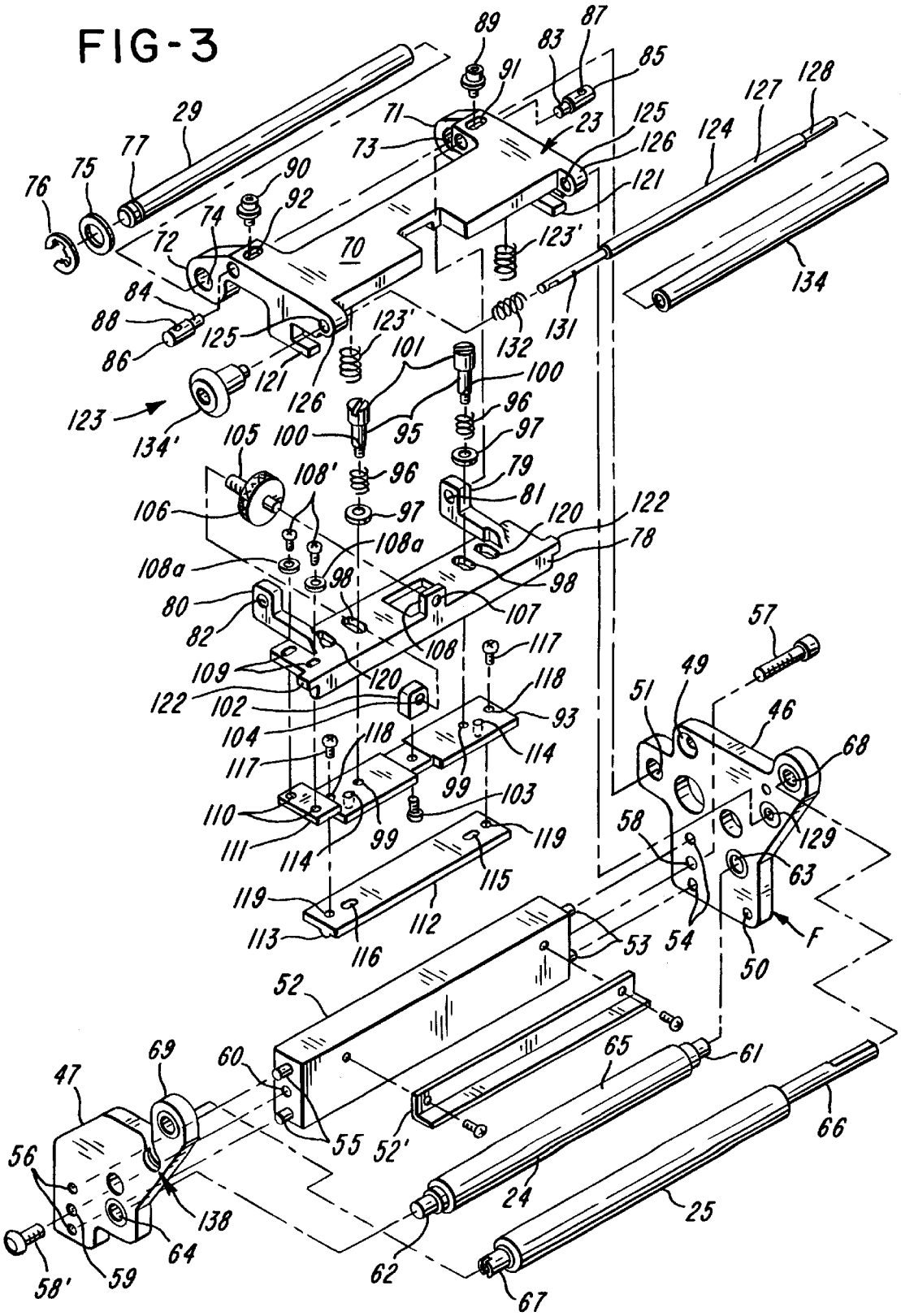
FIG. 3 is an exploded perspective view of one of the upper print modules shown in FIGS. 1 and 2.

With reference to FIG. 3 the rear plate 46 is shown to be connected to the rear plate 47 by a support beam 52 having pins 53 received in holes 54 in the plate 46 and pins 55 received in holes 56 in the plate 47. A screw 57 passing through a hole 58 in the plate 46 is threadably received in a threaded hole (not shown) in the support beam 52, and a screw 58' passing through a hole 59 is threadably received in a threaded hole 60 in the support beam 52, so that the plates 46 and 47 are rigidly connected to provide a cantilevered module frame F. The rear plate 46 constitutes the rear portion and the front plate 47 constitutes the front portion of the module frame F. A guide 52' secured to the beam 52 prevents the web W frame passing upwardly during threading.

The platen roll 24 has stub ends 61 and 62 received in bearings 63 and 64 in the plates 46 and 47. The platen roll 24 is covered with a sleeve 65 composed of an elastomeric material. A drive end 66 and a stub end 67 of the roll 25 are received in bearings 68 and 69 in the plates 46 and 47.

The print head assembly 23 is shown to include a mounting plate or holder 70 having arms 71 and 72 with aligned axial holes 73 and 74. The shaft 29 is received in the holes 73 and 74. A wavy washer 75, and an E-ring 76 received in a groove 77, retain the plate 70 on the shaft 29.

A print head mounting plate 78 has a pair of laterally spaced arms 79 and 80 having respective aligned holes 81 and 82. The holes 81 and 82 receive stub ends 83 and 84 of pivots 85 and 86. Pivots 85 and 86 have respective threaded holes 87 and 88. Cap screws 89 and 90, which pass through elongate aligned slots 91 and 92 in the plate 70 and are threadably received in the holes 87 and 88, enable the plate 70 to be adjusted laterally and releasably secure the plate 78 in the position to which it has been laterally adjusted.

A print head adjusting device or plate 93 is resiliently mounted to and spaced slightly below the plate 78. Screws 95 pass through springs 96, washers 97, elongate slots 98 and are threadably received in threaded holes 99. The screws 95 have shoulders 100, which bear against the washers 97, and the springs 96 bear against the washers 97 and the heads 101 of the screws 95.

A block 102 is threadably secured to the upper side of the plate 93 by a screw 103. The block 102 has a threaded hole 104. The hole 104 rotatably receives a threaded shaft 105 having a thumbwheel 106. An annular unthreaded part of the shaft 105 is rotatably received in a hole 107 in a flange 108 on the plate 78. Rotation of the thumb wheel 106 causes the plate 93 to be adjusted relative to the plate 78 in a direction perpendicular to the lateral direction. The holes 98 are wide enough relative to the screws 95 to enable some lateral adjustment of the plate 93. Screws 108' pass through washers 108*a* and laterally elongated slots 109 and are threadably received in threaded holes 110 in a stop plate 111. Once the lateral adjustment of the plate 93 has been attained, the stop plate 111 is positioned against the end of the plate 93 and the screws 108' are tightened.

A convex-type thermal print head 112 has a convex laterally extending line of thermal printing elements 113. The print head 112 is connected to the print head mounting plate 78 through the plate 93. The underside of the plate 93 has pins 114 which project into holes 115 and 116 in the print head 112. Screws 117 passing through enlarged holes 118 in the plate 93 are threadably received in holes 119 in the print head 112. Holes 120 provide access for enabling the screws 117 to be tightened or loosened.

The plate 70 has tangs or projections 121 which support projections 122 at the ends of the plate 78. Compression springs 123' bear against the underside of the plate 70 and the plate 78 and serve to urge the plates 70 and 78 apart. The movement of the plate 78 apart relative to the plate 70 is, however, limited by the projections 122 bearing against the projections 121.

Figure 4:
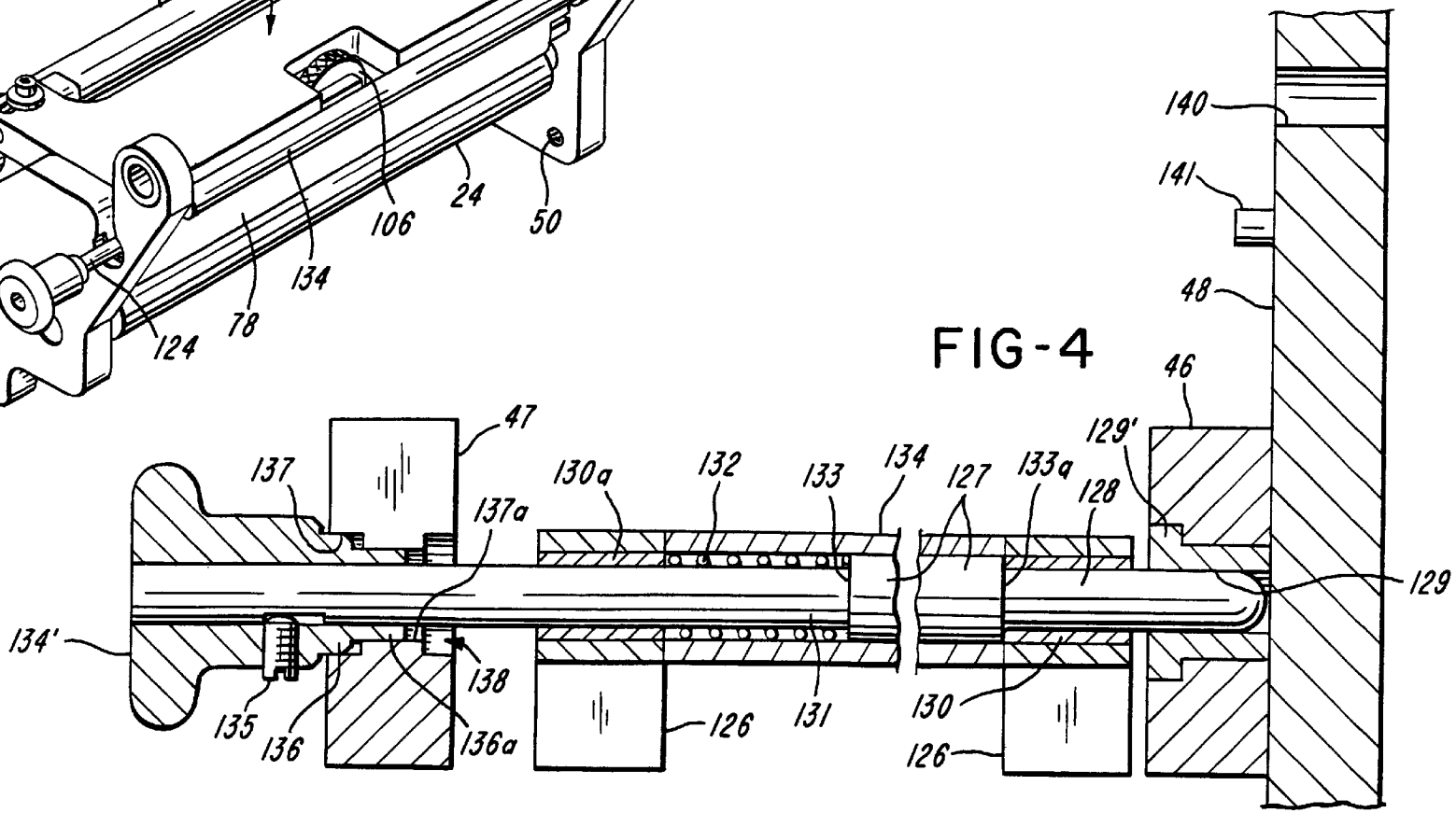
FIG. 4 is a sectional view depicting the quick-release mechanism shown in FIGS. 2 and 3.

A quick-release mechanism generally indicated at 123 locates and holds the print head assembly 23 at an operating position, but enables the print head assembly 23 to be pivoted or moved out of the way to an open or inoperative position to facilitate threading of the web W, cleaning of the print head 112 or to disable the print head from printing at its print station 12 (or 13). The assembly 123 includes a laterally extending locating pin or rod 124 which passes through holes 125 in arms 126 on the plate 70. The rod 124 includes a shaft portion 127. A reduced-diameter end portion 128 of the rod 124 is removably received or located in a bore 129 in a bushing 129' in the plate 46. The end portion 128 is slidable in a bearing 130 (FIG. 4) in the arm 126. Reduced-diameter end portion 131 of the rod 124 receives a compression spring 132 which bears against a bearing 130*a* in the one arm 126 and against a shoulder 133. A tube 134 is received about the shaft portion 127 and the spring 132. The spring 132 urges a shoulder 133*a* on the rod 124 against the bearing 130. The tube 134 fits between the arms 126. A knob or handle 134' is secured by a set screw 135 to the reduced-diameter portion 131 in front of the front plate 47. The knob 134' has a large diameter portion 136 and a small diameter portion 136*a* received respectively in a large diameter bore 137 and a small diameter bore 137*a* in the front plate 47. The bores 137 and 137*a* form an open-sided hole or locating recess generally indicated at 138 in the front plate 47. The spring 132 normally urges the locator rod 124 laterally to the right as seen in FIGS. 3 and 4, so that the end portion 128 seats in the bore 129 and the knob 134' seats in the bores 137 and 137*a*. By pulling on the knob 134' and thereby shifting the portion 128 of the rod 124 out of the bore 129, the knob 134 can be used as a handle to lift the print head assembly 12 or 13 to an open pivoted position about the shaft 29 to the phantom line position shown in FIG. 1. To return the print head assembly 23 to its operating position, the knob or handle 134' is grasped and pulled to the FIG. 2 position. The recesses 129 and 138 are always laterally aligned. When the print head assembly 23 has been pivoted downwardly until the rod 124 is aligned with the hole or recess 138 and the bore or recess 129, the knob 134' is released and the spring 132 causes the knob 134' to seat in the bores 137 and 137*a* and causes the end portion 128 to be received in the bore 129. It is apparent that either or both print head assemblies 23 and the print head assembly 15 can be quickly and accurately located at their printing positions and yet these print head assemblies can be quickly moved to their open positions.

The print head assemblies 12 and 13 can each be held in the open position after rotation of about 85° from the operating position by allowing the end portion 128 to enter a recess 140 in the printer frame 48. If desired the print head assemblies can be held open at about 55° by allowing the end portion to contact a pin 141 on the printer frame 48.

Figure 5:
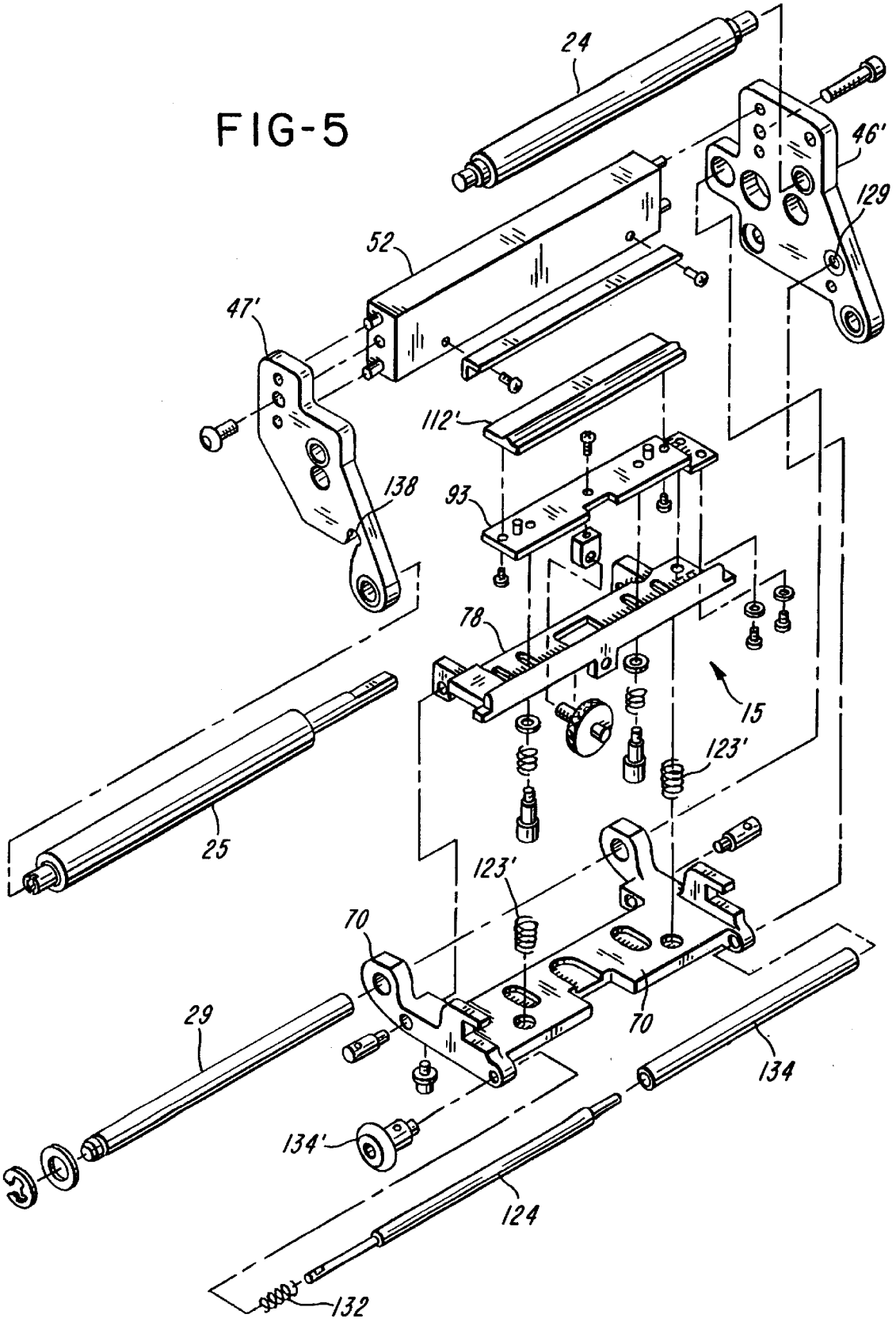
FIG. 5 is an exploded perspective view of the lower print module shown in FIG. 1.

FIG. 5 shows the print head assembly 15 and associated structure. The principles of operation and construction of the structure shown in FIG. 5 is identical to that shown in FIG. 4, however, the rear plate 46' and the front plate 47' differ from respective plates 46 and 47 due to the fact the print head assembly 15 needs to pivot downwardly rather than upwardly as with the print head assemblies 23. In other respect the construction is the same and, therefore, like reference numbers are used to designate like components.

Other embodiments and modifications of the invention will suggest themselves to those skilled in the art, and all such of these as come within the spirit of this invention are included within its scope as best defined by the appended claims.

We claim:

1. A printer, comprising: a printer frame, a print head module cantilevered to the printer frame, the print head module including a module frame having a rear plate secured to the printer frame and a front plate spaced laterally from and connected to the rear plate, laterally aligned locating recesses in the front and rear plates, a print head mounting plate pivotally mounted to the module frame, a thermal print head connected to the print head mounting plate, a platen roll cooperable with the print head to print on a web, a laterally extending locator rod extending to in front of the front plate and graspable from in front of the front plate and mounted to the mounting plate for selective lateral shifting movement either into the locating recesses to locate the print head relative to the platen roll at an operating position or out of the locating recesses to enable the mounting plate to be pivoted to move the print head away from the platen roll to an open position.

2. A printer, comprising: a printer frame, a print head module cantilevered to the printer frame, the print head module including a module frame, the module frame having a rear portion secured to the printer frame and a front portion, a locating recess in the module frame, a print head mounting plate pivotally mounted to the module frame, a thermal print head connected to the print head mounting plate, a laterally extending platen roll cooperable with the print head to print on a web, a laterally extending locator rod accessible from in front of the front portion of the module frame and mounted to the mounting plate for selective lateral shifting movement either into the locator recess to locate the print head relative to the platen roll at an operating position or out of the recess to enable the mounting plate to be pivoted to move the print head away from the platen roll to an open position.

3. A printer as defined in claim 2, including a knob on the locator rod disposed in front of the front portion.

4. A printer as defined in claim 2, wherein the rear portion has the locating recess and the front portion has another locating recess, wherein the locating recesses are laterally aligned, and wherein the locator rod cooperates with both recesses.

5. A printer as defined in claim 2, wherein the front portion has the locating recess, the recess being open sided, the rod having a knob, the knob having a locator portion for locating cooperation in the locating recess.

6. A printer as defined in claim 2, including at least one spring for urging the locator rod into locating cooperation with the recess.

7. A printer as defined in claim 6, wherein the rod includes a manually engageable knob to facilitate shifting of a rod against the action of the spring to a position out of cooperation with the recess.

8. A printer, comprising: a generally vertical printer frame, a print head module cantilevered to the printer frame, the print head module being removable as a unit from the printer frame, the print head module having a rear plate secured to the printer frame and a front plate spaced from and connected to the rear plate, a platen roll rotatable in the front and rear plates, a locating recess provided in the rear plate, a print head assembly including a print head, the print head assembly being movable between an operating position in which the print head cooperates with the platen roll and a non-operating position wherein the print head is away from the platen roll, the front plate having a locating recess with an open side, a rod slidably mounted by the print head assembly, the rod being received in the recesses when the print head assembly is in the operating position, the rod being shiftable into and out of the locating recesses, and the rod being movable through the side opening when the rod is out of the locating recesses to enable movement of the print head assembly between the operating and non-operating positions.

9. A printer as defined in claim 8, wherein the rod includes a knob receiveable in the locating recess in the front plate, and the knob being located in front of the front plate when received in the locating recess in the front plate.

10. A printer as defined in claim 8, wherein the rod includes a knob receiveable in the locating recess in the front plate.

11. A printer, comprising: a printer frame, a print head module, the print head module including a module frame removably secured to and cantilevered from the printer frame, a pair of locating recesses in the module frame, a print head assembly pivotally mounted to the module frame, the print head assembly including a print head, a laterally extending platen roll cooperable with the print head to print on a web, a laterally extending locator rod mounted on the print head assembly for selective lateral shifting movement either into both locating recesses to locate the print head in cooperation with the platen roll at an operating position or out of the locator recesses to enable the print head assembly to be moved to a non-operating position with the print head away from the platen roll.

12. A printer, comprising: a printer frame, a print head module removable as a unit from the printer frame, the print head module including a module frame removably secured to and cantilevered from the printer frame, a print head assembly pivotally mounted to the module frame, the print head assembly including a print head, a laterally extending platen roll mounted to the module frame and cooperable with the print head at an operating position to print on a web, a quick-release rod accessible from in front of the printer frame to releasably locate and hold the print head assembly in its operating position but enabling the print head assembly to be moved to a non-operating position.

13. A printer, comprising: a printer frame, a print head module, the print head module including a module frame removably secured to and cantilevered from the printer frame, a pair of spaced locating recesses in the module frame, a print head assembly pivotally mounted to the module frame, the print head assembly including a print head, a laterally extending platen roll, and a shiftable locator for substantially simultaneously engaging in both locator recesses to releasably locate and hold the print head assembly in an operating position in which the print head cooperates with the platen roll but enabling the print head assembly to be moved to a non-operating position in which the print head is out of cooperation with the platen roll.

14. A printer, comprising: a printer frame, a print head module removable as a unit with respect to the printer frame, the print head module including a module frame removably secured to and cantilevered from the printer frame, the module frame including a rear plate positioned against the printer frame and a front plate spaced forwardly from and connected to the rear plate, a pivotally mounted print head assembly including a print head, a platen roll cooperable with the print head, and a locator accessible from in front of the front plate to locate and hold the print head in cooperation with the platen roll but being shiftable to enable the print head assembly and its print head to move to a non-operating position with the print head out of cooperation with the platen roll.

15. A printer, comprising: a printer frame, a print head module removable as a unit with respect to the printer frame, the print head module including a module frame removably secured to and cantilevered from the printer frame, the print head module including a front plate spaced forwardly from the printer frame, and a pivotally mounted print head assembly including a print head, a platen roll cooperable with the print head, a locator carried by the print head assembly, a locator recess in the module frame, and a handle for the locator, and the handle being disposed in front of the front plate to enable movement of the locator into and out of the locator recess and to move the print head assembly to bring the print head into and out of cooperation with the platen roll.

16. A printer, comprising: a printer frame, a print head module removable with respect to the printer frame, the print head module including a module frame removably secured to and cantilevered from the printer frame, the module frame including a front plate spaced forwardly from the printer frame, a pivotally mounted print head assembly including a print head, a laterally extending platen roll cooperable with the print head, and a laterally extending locator accessible from in front of the front plate to locate and hold the print head in cooperation with the platen roll but being shiftable to enable the print head assembly and its print head to move to a non-operating position.

17. A printer, comprising: a printer frame, a print head module secured to the printer frame, the print head module including a module frame, a movable print head assembly and a platen roll mounted on the module frame, the print head assembly including a print head cooperable with the platen roll in an operating position, a locator recess on the module frame corresponding to the operating position, another recess on the printer frame corresponding to a non-operating position for the print head, and a locator selectively positionable in either recess for holding the print head assembly either in the operating position or in the non-operating position.

18. A printer as defined in claim 17, including a stop for limiting the movement of the print head assembly beyond the non-operating position.

19. A printer for printing on both sides of a web, comprising: a generally vertical printer frame, a first print head module removably connected to the printer frame and including a first module frame, a first print head assembly having a first print head, and a first non-driven rotatable platen roll, wherein the first print head assembly and the first platen roll are mounted on the first module frame, a second print head module removably connected to the printer frame and including a second module frame, a second print head assembly having a second print head, and a second non-driven rotatable platen roll, wherein the second print head assembly and the second platen roll are mounted on the second module frame, a pair of cooperating rolls downstream of the platen rolls for drawing the web along a path past the first and second print heads, wherein the first print head is on one side of the path, wherein the second print head is on the other side of the path, wherein the first print head assembly is accessible from in front of the first module frame for selectively positioning the first print head either in or out of cooperation with the first platen roll, and wherein the second print head assembly is accessible from in front of the second module frame for selectively positioning the second print head either in or out of cooperation with the second platen roll.

20. A printer for printing on both sides of a web, comprising: a printer frame, a plurality of print head modules; each print head module being removable as a unit with respect to the printer frame and including a module frame removably secured to and cantilevered forwardly from the printer frame, a pivotally mounted print head assembly including a print head for printing on a web along a path of web travel, a platen roll cooperable with the print head, a locator carried by the print head assembly, a locator recess in the module frame, a handle for the locator, and the handle being disposed forwardly of the module frame; wherein at least one print head is on one side of the path of web travel, and at least one other print head is on the other side of the path of web travel.

* * * * *